United States Patent [19]

Hendrix et al.

[11] Patent Number: 4,623,356

[45] Date of Patent: Nov. 18, 1986

[54] OXIDATIVE AFTERWASH TREATMENT FOR NON-FORMALDEHYDE DURABLE PRESS FINISHING PROCESS

[75] Inventors: James E. Hendrix, Spartanburg, S.C.; Kimberley J. Lane, Clifton Park, N.Y.; John Y. Daniels, Pineville, N.C.

[73] Assignee: Spring Industries, Inc., Fort Mill, S.C.

[21] Appl. No.: 668,857

[22] Filed: Nov. 6, 1984

[51] Int. Cl.[4] ..... D06L 3/06

[52] U.S. Cl. ..... 8/107; 8/109; 8/111; 8/116.4; 8/108.1

[58] Field of Search ..... 8/107, 108 R, 111, 109

[56] References Cited

U.S. PATENT DOCUMENTS

| | | | |
|---|---|---|---|
| 2,838,459 | 6/1958 | Sprout | 252/186.29 |
| 3,687,627 | 8/1972 | Stalter | 423/273 |
| 3,740,187 | 6/1973 | Kowalski | 8/111 |
| 3,766,078 | 10/1973 | Kowalski | 252/186.29 |
| 3,951,594 | 4/1976 | Smolens | 8/111 |
| 4,285,690 | 8/1981 | North | 8/186 |
| 4,300,898 | 11/1981 | North | 8/185 |
| 4,304,564 | 12/1981 | Frick et al. | 8/194 |
| 4,332,586 | 6/1982 | North | 8/186 |
| 4,345,063 | 8/1982 | North | 528/245 |
| 4,396,391 | 8/1983 | North | 8/181 |
| 4,447,241 | 5/1984 | Hendrix et al. | 8/116.4 |
| 4,472,167 | 9/1984 | Welch | 8/116.4 |

OTHER PUBLICATIONS

E. R. Trotman, "Dyeing and Chemical Technology of Textile Fibres", Fifth Edition, (Griffin, 1975), pp. 239–248.

*Primary Examiner*—A. Lionel Clingman

*Attorney, Agent, or Firm*—Nixon & Vanderhye

[57] ABSTRACT

A method for preventing discoloration of durable press fabrics containing cellulosic fibers that have been previously finished using a non-formaldehyde finishing agent such as glyoxal in which the fabric is treated with an oxidative afterwash solution at elevated temperature followed by neutralization, rinsing and drying. The oxidative afterwash treatment may be performed in a continuous process as part of or immediately following the durable press finishing operation, or at a later time in a totally separate process.

9 Claims, 2 Drawing Figures

OXIDATIVE AFTERWASH TREATMENT FOR NON-FORMALDEHYDE DURABLE PRESS FINISHING PROCESS

BACKGROUND AND SUMMARY OF THE INVENTION

The present invention relates to a finishing process for durable press ("wash and wear") fabrics and, more particularly, to an oxidative afterwash treatment for durable press fabrics containing cellulosic fibers which have been treated with a non-formaldehyde finishing agent.

It is well known that untreated cellulosic fabrics, such as cotton, generally exhibit poor resilience in that they crease or wrinkle easily when crushed. They also have poor dimensional stability and relatively low resistance to shrinkage. In order to overcome those shortcomings, the textile industry has developed various finishing processes to improve the stability and resilience of fabrics containing cellulosic fibers.

A known conventional method for durable press fabrics treats the fabric with a chemical agent that cross-links the cellulose molecules. The chemical reaction is carried out by heating to elevated temperatures to effect the "curing" or cross-linking of the finishing agent and thereby impart crease-resistant properties to the fabric. Many of the commercially-available processes employ, for example, a reactive resin based on formaldehyde such as dimethyloldihydroxyethyleneurea (DMDHEU), a formaldehyde-based resin formed from formaldehyde, glyoxal and urea. Other agents employing nitrogenous cellulose cross-liking agents such as N-methylolamides, are also used in conventional "formaldehyde-based" finishing operations.

In recent years, the concern over the safety of exposure of humans to formaldehyde vapors has resulted in the development of certain non-formaldehyde finishing agents for durable press fabrics such as glyoxal ($C_2H_2O_2$) and non-formaldehyde polymers based on glyoxal such as Sun Chemical's Permafresh ZF, and 1,3-dimethyl-4,5-dimethoxyethyleneurea. Recent studies have shown, for example, that glyoxal is one of the few readily available non-nitrogenous cellulose cross-linking agents that exhibit the high reaction rates required for durable press finishing of cotton. As such, glyoxal offers an attractive alternative to the use of N-methylolamides which liberate formaldehyde vapors during fabric treatment, garment fabrication and apparel use. See Welch, "Glyoxal as a Formaldehyde-Free Durable Press Reagent for Mild Curing Applications", Textile Research Journal, March 1983. However, the use of glyoxal on cellulose containing fabrics in the presence of a catalyst such as aluminum sulfate tends to cause appreciable fabric yellowing and high strength losses. The yellowing can be suppressed, but only to a limited extent, by adding ethylene glycol to the treating formulation to thereby reduce the presence of unreacted aldehyde or hemiacetal groups in the treated fabric. The addition of ethylene glycol also raises the durable press appearance rating of the treated fabric, and increases the resistance of the fabric to laundering abrasion.

Although the use of glyoxal or glyoxal-based polymer finishing agents would reduce the release of formaldehyde vapors during fabric treatment and use, it has been found that the use of such finishes causes moderate to severe yellowing of finished fabrics, particularly upon prolonged storage. That is, fabrics treated with glyoxal will discolor with age and/or exposure to atmospheric contaminants upon storage. A probable explanation for the discoloration is that residual aldehyde and hemiacetal groups interact in the presence of sulfur dioxide, oxygen, ozone, oxides of nitrogen, etc. to produce the undesired yellowing over an extended period of time. Thus, the oxidation of the residual aldehydes to carboxylic acids and cleavage of the hemiacetals may effectively prohibit the formation of color in the fabric.

It has now been found that the discoloration resulting from the use of non-formaldehyde permanent press finishing agents such as glyoxal, polymers of glyoxal and higher aldehydes, particularly the problem of fabric yellowing upon storage over long periods of time, may be eliminated through the use of an oxidative treatment of the treated fabric either simultaneously with or following the durable press finishing operation.

The oxidative treatment according to the present invention restores fabric shade and eliminates yellowing during storage in that it exposes a moist finished fabric to an oxidation solution at an elevated temperature, followed by neutralization, rinsing, and drying operations. The oxidation bath is thought to react with color forming sites in the fabric, thereby eliminating yellowing caused by further reaction at those sites. The oxidative treatment may be performed either during or immediately after curing of the finished fabric in a continuous process, or at a later time as a totally separate process. The equipment necessary to carry out the oxidation can include various combinations of conventional washboxes, steamers and recouperators, so long as the fabric dwell time, oxidant concentration and chemical reaction are adequate to eliminate the undesired yellowing and tendency to discolor upon storage.

A typical oxidation solution according to the invention consists of an oxidant, a stabilizer to retard degradation of the oxidant, a base to control the pH of the oxidative solution, a nonionic surfactant (acting as a wetting agent) and a chelating agent, if desired. The stabilizer and/or base may be optional depending on the choice of the oxidant. Specific but non-limiting examples of oxidants include sodium perborate, sodium percarbonate, sodium peroxide, hydrogen peroxide, sodium perchlorate, peroxyphosphates, persulfates, potassium periodate, and organic per-acids such as peracetic acid. The stabilizer may be any of those known to stabilize bleach baths such as sodium silicate, phosphates, phosphate esters, magnesium salts, phenols, amines, amides, free-radical scavengers or combinations thereof. Likewise, the base, surfactant, and chelating agent may be any of those commonly used in textile bleaching operations.

A typical formulation for an aqueous oxidative afterwash solution according to the present invention is as follows:

sodium percarbonate: 3–4% (by weight of entire bath)
sodium silicate: 0.5–1%
surfactant: 0.1%

The fabric is exposed to the oxidation solution at a temperature between 40° and 200° F. for a period of 5 seconds up to 5 minutes, depending on the strength (concentration) of the oxidation bath. In the preferred embodiment of the invention, the temperature range is between 120° to 160° F. for a period of between 5 and 90 seconds. The fabric is then neutralized with a dilute organic acid (such as dilute acetic acid) rinsed in an aqueous bath, and dried.

The process according to the invention offers a clear advantage over conventional durable press finishing operations in that it provides an efficient and safe method of obtaining a non-formaldehyde durable press fabric which is not discolored after finishing and which will not yellow or become discolored even after extended storage.

Thus, it is an object of the present invention to provide for an efficient and environmentally safe method to eliminate the discoloration resulting from the use of non-formaldehyde durable press finishing agents on cellulosic fibers, particularly the yellowing which occurs upon prolonged storage.

It is a further object of the present invention to provide an afterwash treatment which will eliminate discoloring but not effect the stability, resilience, durability or strength characteristics of the treated fabric.

It is still a further object of the present invention to provide for a continuous oxidative afterwash treatment simultaneously with the durable press finishing which will eliminate discoloring and the tendency to discolor.

Other features, objects and advantages of the invention will appear more fully from the following description of illustrated embodiments taken in conjunction with the appended drawings.

DETAILED DESCRIPTION OF THE DRAWINGS

Figure 1:
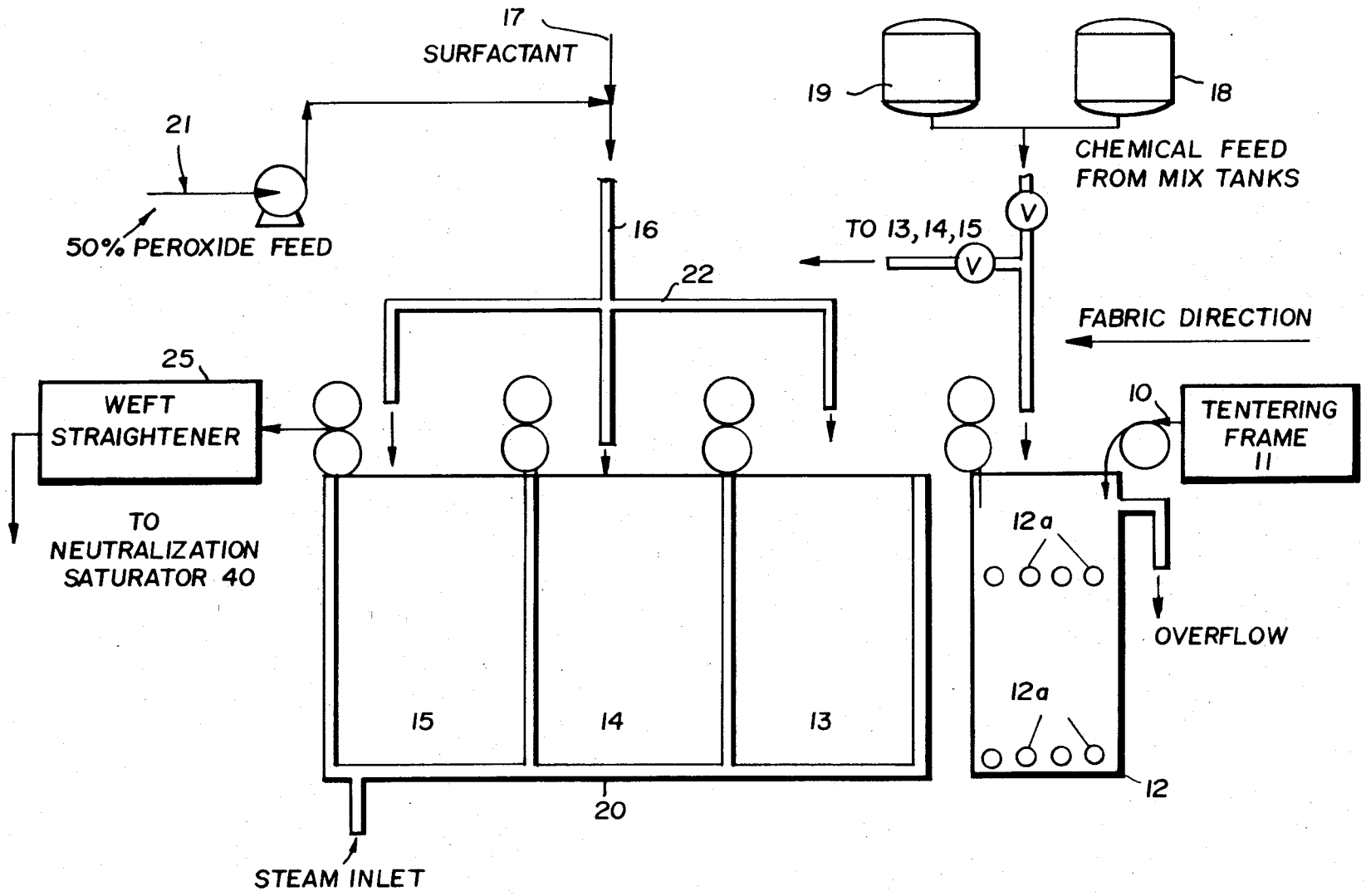
FIG. 1 of the drawings is a process flow diagram illustrating the principal steps and equipment necessary to carry out the oxidative afterwash in the process according to the present invention.

Referring to FIG. 1, fabric 10 containing cellulosic fibers has been previously finished with a non-formaldehyde durable press finishing agent such as glyoxal. The fabric may be treated in accordance with the present invention as follows:

Fabric 10 (which has already been dipped in glyoxal, squeezed and predried) first proceeds through tentering frame 11. Upon exiting the tentering frame, it passes through fabric saturator 12 containing fabric rollers 12*a* into three counter-flowed washboxes, 13, 14 and 15, respectively, charged with an oxidative afterwash formulation in accordance with the present invention. The afterwash formula is mixed in saturator 12 and washboxes 13, 14 and 15 with the necessary amounts of nonionic stabilizer and base (such as caustic) being added first to the nearly full washers. The necessary mixing may be accomplished by conventional means such as by way of a pipe connected to a compressed air line. The alkali concentration of the oxidative solution may also be checked by titration at this point and adjusted if necessary. In this regard, it has been found that the optimum pH level during the oxidative afterwash treatment in washboxes 13, 14 and 15 should remain between 10.5 and 11.4. If the pH is above or below this range, the stability of the peroxide and efficiency of the process will be reduced.

The required amount of oxidant (such as hydrogen peroxide) is added as shown generally at 16 and the entire oxidative bath is mixed to ensure a uniform bath concentration and temperature. Titrations may also be made after oxidant addition in order to monitor and adjust its concentration. The nonionic surfactant is added as shown at 17. Concurrently, two head tanks, 18 and 19, are prepared on a level above the washboxes to feed directly to saturator 12 to maintain a liquid level and concentration sufficient to complete the oxidative reaction.

Because the oxidative reaction occurs at an elevated temperature, the washboxes are heated via steam jacket 20 immediately prior to running. Also, in order to maintain the required oxidant concentration in the washboxes, an electrically driven pump 21 feeds concentrated oxidant (such as 50% hydrogen peroxide) through a distribution manifold 22 into the washboxes. After exiting the last washbox, fabric 10 passes through a weft straightener 25 to neutralization saturator 40 to complete the oxidative afterwash step in accordance with the invention.

Figure 2:
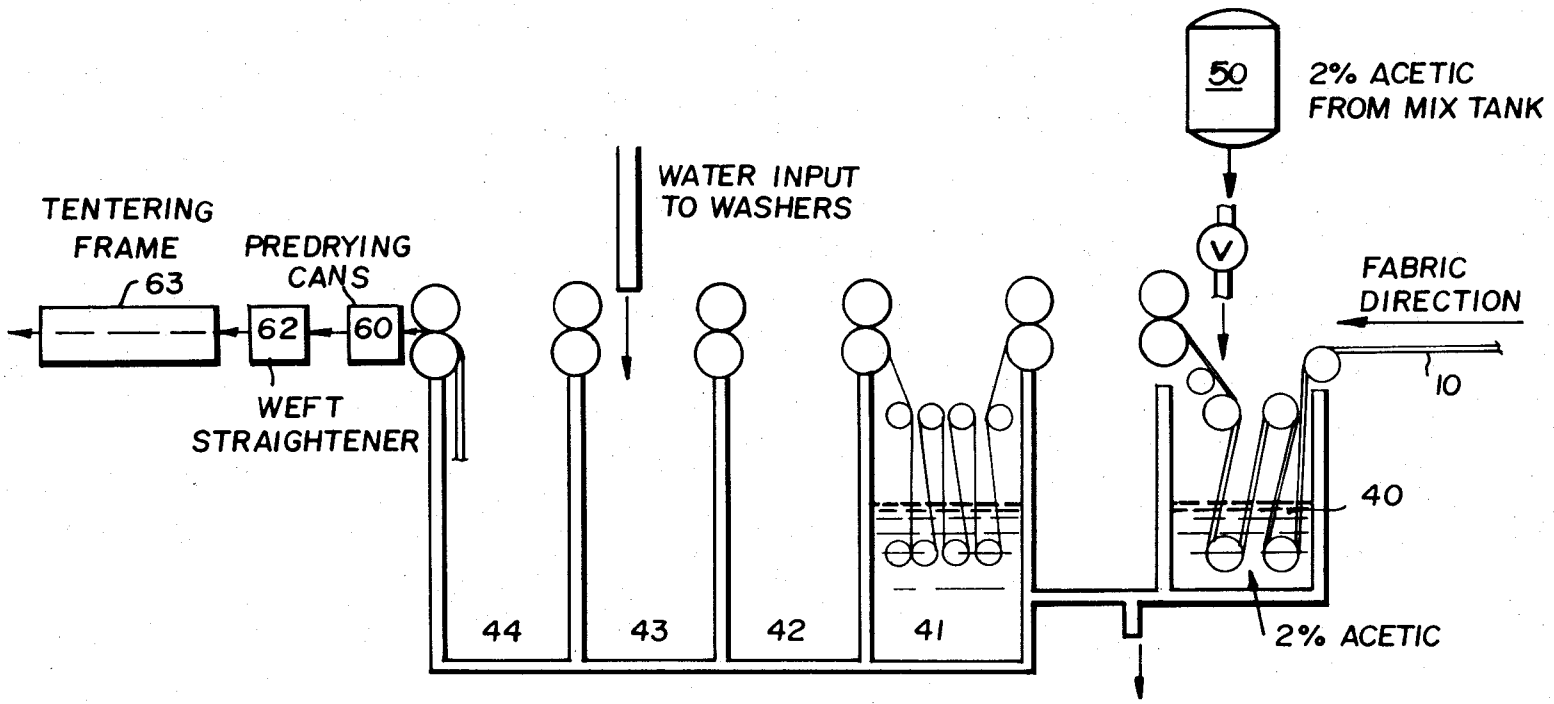
FIG. 2 illustrates the neutralization, rinsing and drying operations following the oxidative treatment in the process according to the invention.

The neutralization, rinsing and drying operations according to the invention are depicted in FIG. 2. Fabric 10 proceeds through a neutralization saturator 40 and four counter-flowed shallow washers, 41, 42, 43 and 44, respectively. Saturator 40 is maintained at a constant liquid level and pH with, for example, a 2.0% acetic acid solution which is fed from head tank 50. The neutralization reduces the pH down to a level of approximately 5.0 and is done at a "cold" temperature, i.e. in the range of 70° F. Preferably, fabric 10 is subjected to two consecutive dips in neutralization saturator 40.

Following neutralization, the fabric is rinsed by passing it through the four counter-flowed washers, 41, 42, 43 and 44, receiving a total of 12 dips. It then proceeds over a series of predrying cans (shown collectively as 60), a weft straightener 62, and onto tentering frame 63 for final drying. The dried, afterwashed and bleached fabric is then batched in a conventional manner.

As those skilled in the art will appreciate, the processing equipment depicted in FIGS. 1 and 2 are not intended to be limiting but is merely illustrative of the basic process steps according to the invention.

EXAMPLE I

A trial was conducted using the processing equipment depicted in FIG. 1 to evaluate the feasibility of oxidative afterwashing on a typical non-formaldehyde finished fabric containing cellulosic fibers (65 percent polyester/35 percent cotton shirting). The fabric was then batched wet and run through an acetic acid neutralization, rinsed, and immediately dried on a tentering frame as depicted in FIG. 2. The fabric was, therefore, processed in separate operations—first, oxidative afterwashing, followed by neutralization, rinsing and drying. As those skilled in the art will appreciate, however, the process steps according to the invention may be carried out on a continuous basis without any interruption between the oxidation, neutralization, rinsing or drying steps.

The oxidative afterwashing used the following formulation:

1% sodium silicate*

1% of 50% sodium hydroxide (caustic)
3% of 50% hydrogen peroxide
0.1% of Springscour 155 (a nonionic surfactant)
*All percentages are based on the weight of the bath ("% OWB").

Approximately 1300 yards of a fabric containing cellulosic fibers (65% polyester/35% cotton) and finished with a non-formaldehyde glyoxal finish formulation in a previous trial, was subjected to the following oxidative afterwash treatment. The finished fabric proceeded through a tentering frame at 60 ypm in which the drying oven temperature was approximately 250° F. at the beginning of the trial.

After exiting the tentering frame, the fabric passed through a 197 gallon saturator followed by three counterflowed 353 gallon washboxes charged with the above afterwash formulation. At the 60 ypm speed, the residence time in the afterwash bath was approximately 21 seconds. The afterwash formula was mixed directly in the saturator and washers with necessary amounts of sodium silicate and caustic added to nearly full washers. The mixing was accomplished by using a ⅜-inch diameter, 60-inch pipe connected to a compressed air line. The alkali concentration was titrated and adjusted to a pH level between 10.5 and 11.1. The required amount of 50% hydrogen peroxide was then added and the bath was again mixed. A second titration was made to determine the peroxide level and the concentration adjusted to comply with the desired formulation. The nonionic surfactant was then added to the final afterwash solution.

As part of the after wash treatment, two 250-gallon head tanks were prepared on the mezzanine level above the washboxes for purposes of feeding directly to the saturator to maintain the necessary liquid level and oxidant concentration. The washers themselves were heated via a steam jacket to 160° F. immediately prior to running the trial. In order to maintain the required peroxide concentration in the washers due to decomposition of the peroxide at elevated temperatures, an electrically driven pump was used to feed 50% hydrogen peroxide through a distribution manifold into the washers. The pump output volume was governed by a variac transformer and could be varied from 0.4 to 1.7 gallons per minute.

After exiting the last washer, the fabric was batched wet to await neutralization, rinsing and drying.

The neutralization, rinsing and drying steps were carried out as generally illustrated in FIG. 2. The batch wet fabric was passed through a saturator and four counterflowed shallow washers with the saturator being maintained at 71° F. and a constant liquid level with a 2.0% acetic acid solution fed from a head tank. The fabric was subjected to two dips in the saturator with a total residence time of approximately 4 seconds at a 70 ypm range speed. The fabric then passed through four counter-flowed washers receiving a total of 12 dips with a residence time through the washing of approximately 26 seconds. The washer temperature was maintained at 165° F. using steam-heated plate heaters located in the washer walls. A patch of fabric was taken using a sampling gun following the last washer and tested for pH and sodium acetate concentration. No sodium acetate was present and the fabric pH was found to be between 6.0 and 6.5. The fabric was then passed through a weft straightener and onto a tentering frame. The frame temperature was initially 300° F., but dropped to 250° F. at the end of the run. After drying, the fabric was batched and tested for whiteness, shrinkage, accelerator weight loss, strength and durable press and then compared with a resin "control" fabric as set forth in Table 2 below.

TABLE 2

| Description | Sample | DP[1] 1W | DP[1] 5W | Shrinkage[2] 1W | Shrinkage[2] 5W[4] |
|---|---|---|---|---|---|
| Glyoxal | 1 | 3.25 | 3.25 | .75 × .56 | .94 × .94 |
| | 2 | 3.50 | 3.25 | .56 × .56 | 1.11 × .94 |
| | 3 | 3.25 | 3.25 | .56 × .56 | .94 × .94 |
| | 4 | 3.25 | 3.25 | .83 × .75 | 1.11 × .75 |
| | 5 | 3.50 | 3.33 | .56 × .56 | .94 × .56 |
| Resin Control[3] | 6 | 3.25 | 3.25 | .75 × .56+ | .94 × .56+ |
| Avg. Glyoxal | (1–5) | 3.35 | 3.26 | .65 × .59 | 1.00 × .83 |

Notes:
[1]Durable press rating based on average of three samples (max. = 5.0) using test procedures adopted by the American Assn. of Textile Chemists and Colorists, "Appearance of Durable Press Fabrics After repeated Home Launderings", AATCC124-1978.
[2]Percent shrinkage after 1 wash and 5 washings in warp and weft directions, respectively (acceptable ratings less than 1.0), Dimensional Changes in Automatic Home Laundering of Woven and Knit Fabrics, 135-1978.
[3]Dimethyloldihydroxyethyleneurea (DMHEU).
[4]Number of home launderings prior to rating of property.

| Description | Sample | Whiteness[4] | AWL[5] % | Tensile[6] (lbs) | Tear (g)[7] |
|---|---|---|---|---|---|
| Glyoxal | 1 | 171.12 | 5.89 | 90 × 51 | 1800 × 1300 |
| | 2 | 175.51 | 6.09 | 91 × 50 | 1750 × 1300 |
| | 3 | 174.14 | 5.52 | 92 × 48 | 1750 × 1250 |
| | 4 | 176.96 | 6.70 | 92 × 49 | 1800 × 1350 |
| | 5 | 174.89 | 6.04 | 91 × 50 | 1850 × 1250 |
| Resin Control[3] | 6 | 184.74 | 3.59 | 82 × 43 | 1300 × 850 |
| Avg. Glyoxal | (1–5) | 174.52 | 6.05 | 91 × 50 | 1790 × 1290 |

Notes:
[4]Whiteness measured using reflectance spectrophotometer. Higher values represent greater whiteness. The Whitness Index value is determined from C.I.E. Tristimulus values were the Whiteness Index = 4Z − 3Y.
[5]Accelerator weight loss based on ASTM guidelines, "Accelerator Method", AATCC 93-1978. (an approximation of abrasion resistance of fabric measured before and after "tumbling" against sandpaper)
[6]Tensile strength of fabric in the warp and weft directions, respectively, using Instron tensile tester, "Breaking Load and Elongation of Fabrics", ASTM D 1962.
[7]Tear strength of fabric in grams in the warp and weft directions, respectively, based on Instron testing, "Tear Resistance of Woven Fabrics by Falling - Pendulum (Elmendorf) Apparatus", ASTM D 1424.

Figure 3:
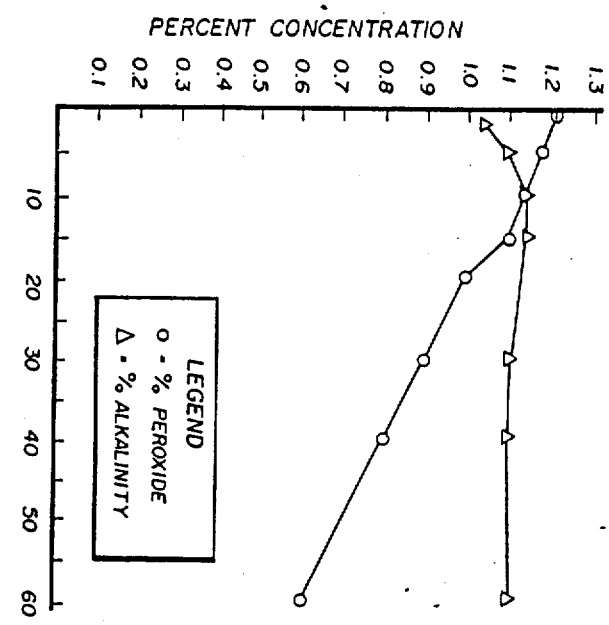
FIG. 3 graphically illustrates the decomposition of hydrogen peroxide used in accordance with the invention at 160° F. over time.

The results achieved during the trial in Example I also indicate that the afterwash formulation used in accordance with the present invention is heat-sensitive. For example, at the recommended operating temperature of 160° F., the hydrogen peroxide loss was found to be approximately 1.0% per minute. FIG. 3 of the drawings shows the decomposition of peroxide at 160° F. over time.

Because rapid decomposition of the oxidant occurs at higher temperatures in a continuous process, means for providing continuous makeup of peroxide to the afterwash bath are necessary to maintain the required concentration level. In this connection, the following temperature measurements and chemical concentrations were recorded during Example I.

| Time | | Wash Boxes: Saturator | $W_1$ | $W_2$ | $W_3$ |
|---|---|---|---|---|---|
| 1:30 (Time = 0)[1] | Temp. °F. | 146 | 162 | 163 | 163 |
| | Alkali %[2] | 1.29 | — | 0.99 | — |
| | Peroxide % of 50% | 2.97 | — | 2.14 | — |
| 1:50 (20 min.) | Temp. °F. | 180 | 178 | 170 | 170 |
| | Alkali, % | — | — | 0.97 | — |
| | Peroxide % of 50% | — | — | 2.48 | — |
| 2:15 (35 min.) | Temp. °F. | 173 | 170 | 169 | 169 |
| | Alkali, % | — | — | 0.91 | — |
| | Peroxide % | — | — | 2.76 | — |

-continued

| Time | | Wash Boxes Saturator | $W_1$ | $W_2$ | $W_3$ |
|---|---|---|---|---|---|
| | of 50% | | | | |
| 2:17 (37 min.) | Temp. °F. | 172 | 169 | 168 | 168 |
| Lot Ends | Alkali, % | — | — | 0.92 | — |
| | Peroxide % of 50% | — | — | 3.42 | — |

Notes:
[1]Concentrations in Head Tank for Saturator at start of run: 1.41% Alkali, 3.66% Peroxide
[2]Percentages based on the weight of bath

EXAMPLE II

In order to determine whether a glyoxal-finished fabric could be oxidatively treated in a continuous process to yield a white, non-formaldehyde fabric with good durable-press properties, oxidative afterwash trials were also run using a wet-bottom steamer (recouperator). Referring to the figures, saturator 12 in FIG. 1 could, for example, be replaced by a wet bottom steamer. Following oxidation the fabric proceeds straight to the neutralization equipment (rather than to wash boxes 13, 14 and 15) as shown in FIG. 2. In this Example, the fabrics were exposed to the oxidation bath in the steamer for either 30, 60, or 90 seconds at 160° F. Following oxidation, the fabrics were rinsed, neutralized, rinsed, dried again, and then examined for whiteness and resilience. As the following tables indicate, exposure times over 90 seconds have a detrimental effect on the durable-press properties. The specific oxidation conditions and physical properties of the tested fabrics are as follows.

TABLE 3

| Oxidative Afterwash Formula For Example II Fabrics | |
|---|---|
| Chemical | % OWB |
| Silicate | 1% |
| Caustic | 1% |
| Chelating Agent[1] | 1% |
| Hydrogen Peroxide | 3% |
| Operating Temperature: | 160° F. |
| Procedure: | |
| Oxidize, rinse on jig, sour with acetic acid, rinse, dry (250° F./1 min.) | |

Notes:
[1]Plexene D

TABLE 4

| Sample | DP 1W | DP 5W | Shrinkage 1W | Shrinkage 5W | % AWL | Whiteness |
|---|---|---|---|---|---|---|
| Resin Control | 3.4 | 3.4 | .0 × .0 | .3 × .0 | 3.39 | 188 |
| Glyoxal 40LF[1] (not oxidized) | 3.5 | 3.4 | .0 × .0 | .3 × .0 | 12.81 | 159 |
| Glyoxal 40LF (30 sec. ox.) | 3.5 | 3.3 | .6 × .6 | .8 × .6 | — | 177 |
| Glyoxal 40LF (60 sec. ox.) | 3.4 | 3.3 | .3 × .4 | .6 × .4 | 5.81 | 182 |
| Glyoxal 40LF (90 sec. ox.) | 3.3 | 3.3 | .6 × .3 | .6 × .6 | 5.35 | 178 |

Notes:
[1]Commercially available glyoxal-based formula manufactured by American Cyanamid.

The foregoing tables in Example II demonstrate that a glyoxal-treated durable-press fabric known to give good durable-press performance can be whitened by an afterwash in accordance with the present invention and still retain desirable physical properties such as low shrinkage and high durable press ratings. In particular, oxidative afterwashing using a wet-bottom steamer (recouperator) afforded a white non-formaldehyde finished fabric with commercially acceptable durable-press properties. In addition, the accelerotor weight loss was reduced by the afterwash treatment.

EXAMPLE III

Additional afterwashing trials were performed on a cellulosic fabric which had previously been finished with Glyoxal 40LF. Three afterwashing parameters were studied—temperature, time, and concentration (expressed as a percent of the oxidation formula). The procedure involved exposing fabrics to the oxidation solution for the appropriate time and temperature, rinsing in hot water (1 minute), souring with 2% acetic acid, rinsing in hot water (1 minute), and drying (250° F./30 sec.).

The afterwash formulations used and testing results are shown in Tables 5 and 6 below.

TABLE 5

| Chemical | % OWB |
|---|---|
| A. FINISH FORMULA | |
| glyoxal (40%) | 12.0 |
| Polydimethyl siloxane fluid emulsion | 1.5 |
| Catalyst[1] | 4.0 |
| Springswet 300[2] | 0.1 |
| Dry temp/time | 250° F./min. |
| Cure temp/time | 400° F./20 sec. |
| B. OXIDATION FORMULA | |
| Silicate | 1.0 |
| Caustic | 1.0 |
| Hydrogen Peroxide | 3.0 |
| Springscour 155[3] | 0.1 |

Notes:
[1]Magnesium sulfate/aluminum sulfate blend
[2]Blend of anionic and nonionic surfactants
[3]Blend of alcohol and phenol ethoxylates

TABLE 6

| Sample | Afterwash Conditions Concentration[1] | Temperature (°F.) | Time (Min) | DP 1 Wash | DP 5 Washes | Shrinkage 1 Wash | Shrinkage 5 Washes | Whiteness |
|---|---|---|---|---|---|---|---|---|
| 1 | Original | (No afterwash) | | 3.5 | 3.5 | .28 × 0 | .56 × 0 | 135.84 |
| 2 | 1 | 160 | 30 | 3.0+ | 3.0+ | .28 × 0 | .56 × 0 | 172.90 |
| 3 | 1 | 160 | 15 | 3.0+ | 3.0+ | .28 × 0 | .28 × 0 | 171.44 |
| 4 | 1 | 160 | 10 | 3.0+ | 3.0+ | .28 × 0 | .56 × 0 | 173.08 |
| 5 | 1 | 160 | 0.5 | 3.5 | 3.5 | .28 × 0 | .56 × .28 | 149.48 |
| 6 | 4/3 | 160 | 30 | 3.0+ | 3.0+ | .28 × 0 | .28 × 0 | 173.92 |
| 7 | 4/3 | 160 | 10 | 3.0+ | 3.0+ | .28 × 0 | .28 × 0 | 172.75 |
| 8 | $\frac{2}{3}$ | 160 | 30 | 3.0+ | 3.0+ | .56 × 0 | .75 × 0 | 171.34 |
| 9 | $\frac{2}{3}$ | 160 | 10 | 3.0+ | 3.0+ | .56 × 0 | .75 × 0 | 169.43 |
| 10 | $\frac{1}{3}$ | 160 | 30 | 3.0+ | 3.0+ | .56 × .28 | .56 × .28 | 172.18 |
| 11 | $\frac{1}{3}$ | 160 | 10 | 3.5 | 3.5 | .28 × 0 | .56 × 0 | 165.31 |

TABLE 6-continued

| Sample | Afterwash Conditions | | | DP | | Shrinkage | | Whiteness |
|---|---|---|---|---|---|---|---|---|
| | Concentration[1] | Temperature (°F.) | Time (Min) | 1 Wash | 5 Washes | 1 Wash | 5 Washes | |
| 12 | 1 | 140 | 30 | 3.5 | 3.5 | .56 × 0 | .75 × 0 | 176.84 |
| 13 | 1 | 140 | 10 | 3.5 | 3.5 | .0 × 0 | .0 × 0 | 174.10 |
| 14 | 4/3 | 140 | 30 | 3.0+ | 3.0+ | .56 × 0 | .75 × 0 | 176.86 |
| 15 | 4/3 | 140 | 10 | 3.0+ | 3.0+ | .56 × 0 | .75 × 0 | 175.71 |
| 16 | ⅔ | 140 | 30 | 3.5 | 3.5 | .56 × 0 | .75 × 0 | 175.52 |
| 17 | ⅔ | 140 | 10 | 3.0+ | 3.0+ | .56 × 0 | .83 × 0 | 168.45 |
| 18 | ⅓ | 140 | 30 | 3.0+ | 3.0+ | .28 × 0 | .56 × 0 | 169.56 |
| 19 | ⅓ | 140 | 10 | 3.5 | 3.5 | .28 × 0 | .28 × 0 | 162.11 |
| 20 | 4/3 | 100 | 30 | 3.5 | 3.5 | .28 × 0 | .56 × 0 | 173.28 |
| 21 | 4/3 | 100 | 10 | 3.0+ | 3.0+ | .28 × 0 | .56 × 0 | 168.93 |
| 22 | ⅔ | 100 | 30 | 3.0+ | 3.0+ | .28 × 0 | .56 × 0 | 172.65 |
| 23 | ⅔ | 100 | 10 | 3.5 | 3.5 | .28 × 0 | .56 × 0 | 167.16 |
| 24 | ⅓ | 100 | 30 | 3.5 | 3.5 | .28 × 0 | .56 × 0 | 164.81 |
| 25 | ⅓ | 100 | 10 | 3.5 | 3.5 | .28 × 0 | .28 × 0 | 157.20 |
| 26 | 1 | 100 | 30 | 3.0+ | 3.0+ | .56 × 0 | .56 × 0 | 173.46 |
| 27 | 1 | 100 | 15 | 3.0+ | 3.0+ | .28 × 0 | .56 × 0 | 171.15 |
| 28 | 1 | 100 | 10 | 3.0+ | 3.0+ | .28 × .28 | .28 × .28 | 166.82 |
| 29 | 1 | 100 | 5 | 3.0+ | 3.0+ | .28 × 0 | .56 × 0 | 161.08 |
| 30 | 1 | 100 | 0.5 | 3.5 | 3.0+ | .0 × 0 | .28 × 0 | 143.18 |
| 31 | Unfinished | | | 2.5 | 2.5 | 1.94 × 1.11 + | 2.22 × 1.11+ | 178.70 |
| 32 | Resin Control[2] | | | 3.0+ | 3.0+ | .28 × .56 | .56 × .56 | 175.79 |

Notes:
[1]Expressed as fraction of the given oxidation formula
[2]DMDHEU

From the foregoing, it is clear that longer dwell times, higher concentrations, and higher temperatures afford whiter fabrics. Also, durable press results matched or exceeded those obtained on the resin control.

EXAMPLE IV

A two-part study was conducted to determine the effectiveness of batch afterwashing on non-formaldehyde durable press fabrics finished with glyoxal (40%). The first part consisted of a simulation of plant processing conditions where the glyoxal (40%) fabric was finished using a vacuum slot extraction apparatus and then afterwashed in a batch process using a Burlington Beck apparatus. Three fabric styles were studied (identifed as "S/411", "S/638", and "S/520"). The glyoxal (40%) samples were subjected to two sets of curing conditions (see Table 8) and then afterwashed according to the formula and conditions shown in Tables 7 and 8, respectively. The test results shown in Table 9 indicate that good physical properties and whiteness were obtained on the afterwashed samples when compared to the resin control.

The second portion of the study used different concentrations of oxidants to determine the required minimum level for acceptable whiteness. The formulations and results shown in Table 10 and the graphical representation of FIG. 4 indicate that whiteness values decrease sharply if the oxidant concentration falls below approximately 1% peroxide owb.

TABLE 7

| Chemical | % OWB |
|---|---|
| A. FINISH FORMULATIONS | |
| 1. Non-Formaldehyde | |
| Glyoxal 40LF | 25.0 |
| polydimethylsiloxane emulsion | 3.0 |
| Catalyst[1] | 8.3 |
| Springswet 300 | 0.2 |
| 2. Resin Control | |
| Aerotex 901 | 15.0 |
| Softener 1442J[2] | 2.0 |
| Catalyst 135B[3] | 3.8 |
| Springswet 300 | 0.2 |
| B. AFTERWASH FORMULATION[4] | |

TABLE 7-continued

| Chemical | % OWB |
|---|---|
| (NON-FORMALDEHYDE FINISH ONLY) | |
| Silicate | 0.2 |
| Caustic (50%) | 0.2 |
| C. FABRIC DESCRIPTIONS | |
| S/411 - 65/35 polyester/cotton broadcloth, 110 × 76, 45's warp end filling, 3.1 oz/yd² | |
| S/520 - 65/35 polyester/cotton gabardine, 108 × 60, 22's warp, 17's filling, 6.0 oz/yd² | |
| S/638 - 65/35 polyester/cotton broadcloth, 128 × 72, 50's warp end filling, 3.0 oz/yd² | |
| Hydrogen Peroxide (50%) | 0.6 |
| Springscour 155 | 0.05 |

Notes:
[1]Blend of magnesium sulfate and aluminum sulfate.
[2]Blend of fatty acid ethoxylates
[3]Magnesium chloride
[4]Liquor/goods weight ratio = 20:1

TABLE 8

| Processing Parameters | | |
|---|---|---|
| A. | FINISHING: | |
| | Speed: | 50 YPM |
| | WPU[1]: | Vacuum Slot<br>S/411 = 25.4%<br>S/638 = 30.6%<br>S/520 = 35.5% |
| | Drying On Cans | |
| | Cure[2]: | 1 Non-Formaldehyde<br>400° F./20 sec.<br>or 380° F./40 sec.<br>2. Resin Control<br>400° F./20 sec. |
| B. | AFTERWASHING (NON-FORMALDEHYDE ONLY USING BURLINGTON BECK) | |
| | Oxidation: | 30 minutes at 160° F. |
| | Rinse: | 5 minutes at 160° F. |
| | Neutralization: | 5 minutes at ambient temperature with 0.08% acetic acid (or until fabric is just acid) |
| | Rinse: | 5 minutes at 160° F. |
| | Dry: | 250° F./1 minute on frame at 44– |

TABLE 8-continued

| Processing Parameters |
|---|
| 45" |

Notes:
[1]Wet pick-up or calculated as percent of dry fabric weight
[2]Fabric is cured in a tentering oven at 420° F. for 20 seconds to effect the crosslinking reaction

TABLE 9

| | | DP[1] | | Shrinkage | |
|---|---|---|---|---|---|
| Style | Sample | 1W | 5W | 1W | 5W |
| S/411 | GLY(400) | 3.33 | 3.50 | .28 × .28 | .56 × .56 |
| | GLY(380) | 3.50 | 3.50 | .28 × .56 | .28 × .56 |
| | GLY(400) 2 AW[2] | 3.50 | 3.50 | .28 × .28 | .56 × .56 |
| | GLY(380)AW | 3.33 | 3.33 | .28 × .56 | .28 × .56 |
| | Resin Control | 3.25 | 3.25 | .28 × .83 | .56 × .83 |
| | Unfinished | 2.50 | 2.50 | 1.67 × .0 | 1.89 × .0 |
| S/638 | GLY(400) | 3.33 | 3.33 | .28 × .28 | .56 × .28 |
| | GLY(380) | 3.25 | 3.25 | .28 × .28 | .28 × .56 |
| | GLY(400)AW | 3.17 | 3.25 | .28 × .28 | .56 × .28 |
| | GLY(380)AW | 3.25 | 3.25 | .28 × .28 | .56 × .56 |
| | Resin Control | 3.25 | 3.25 | .56 × .28 | .56 × .56 |
| | Unfinished | 2.50 | 2.50 | 2.22 × 1.39+ | 2.78 × 1.67+ |
| S/520 | GLY(400) | 3.50 | 3.50 | .56 × .83 | 1.11 × 1.11 |
| | GLY(380) | 3.83 | 4.00 | .56 × .56 | .83 × .83 |
| | GLY(400)AW | 3.50 | 3.50 | .75 × .56 | 1.39 × .56 |
| | GLY(380)AW | 3.67 | 3.83 | .83 × .83 | 1.39 × .83 |
| | Resin Control | 2.67 | 3.67 | .56 × .83 | .83 × .94 |
| | Unfinished | 2.00 | 2.50 | 2.50 × .56+ | 3.33 × .56+ |

| Style | Sample | AWL % | Whiteness |
|---|---|---|---|
| S/411 | GLY(400) | 14.60 | 142.09 |
| | GLY(380) | 14.53 | 141.35 |
| | GLY(400)AW | 8.98 | 161.74 |
| | GLY(380)AW | 7.74 | 173.06 |
| | Resin Control | 2.53 | 163.52 |
| | Unfinished | 0.28 | 190.05 |
| S/638 | GLY(400) | 14.20 | 147.49 |
| | GLY(380) | 13.93 | 147.57 |
| | GLY(400)AW | 8.94 | 165.40 |
| | GLY(380)AW | 8.47 | 162.88 |
| | Resin Control | 2.46 | 186.69 |
| | Unfinished | 0.89 | 192.99 |
| S/520 | GLY(400) | 13.82 | 123.31 |
| | GLY(380) | 14.47 | 123.55 |
| | GLY(400)AW | 9.41 | 168.81 |
| | GLY(380)AW | 8.40 | 167.40 |
| | Resin Control | 4.74 | 181.81 |
| | Unfinished | 1.65 | 183.35 |

Notes:
[1]Average of 3 samples
[2]GLY(400) AW is interpreted as glyoxal cured at 400° F. and given the oxidative afterwash.

TABLE 10

A. FORMULATIONS: 160-180° F. at 20:1 Liquor to Goods for 30 min.

| | Samples | | | | |
|---|---|---|---|---|---|
| Chemicals (% OWB) | 1 | 2 | 3 | 4 | 5 |
| Silicate | 1.0 | .33 | .17 | .10 | — |
| Caustic (50%) | 1.0 | .33 | .17 | .10 | — |
| Hydrogen Peroxide (50%) | 3.0 | 1.0 | .50 | .30 | — |
| SS 155 | 0.1 | 0.1 | 0.1 | 0.1 | 0.1 |

B. RESULTS

| Sample | Whiteness |
|---|---|
| 1 | 173.45 |
| 2 | 170.00 |
| 3 | 164.83 |
| 4 | 153.61 |
| 5 | 136.09 |
| Non-oxidize Control | 136.74 |

The above data demonstrates that the durable press results were equivalent to or exceeded the resin control and that the non-formaldehyde fabric was rendered white by the oxidative afterwash. Further, the whiteness of afterwashed fabrics decreased sharply at a peroxide level below 1% owb at 160°-180° F. in the washers.

As indicated above, the oxidative treatment in accordance with the present invention may be carried out by adding the oxidant to the non-formaldehyde finishing formula itself. That is, the treatment may be conducted simultaneously with a durable press finishing operation using, for example, glyoxal. An example of such simultaneous operation without the necessity for a separate afterwashing treatment is set forth below.

EXAMPLE V

The following finish formulations were evaluated to determine the effects of oxidizing agents in the finish bath on the yellowing of fabrics treated with glyoxal. In each example, Springs 65/35 polyester/cotton Style 638 was padded with a wet pickup to apprxoimately 60 percent. The samples were dried after padding in the laboratory oven at 250° F. for 30 seconds, then cured in the oven at 400° F. for 20 seconds.

| Chemicals (Grams/500 ml) | Mix 1 | Mix 2 | Mix 3 |
|---|---|---|---|
| Glyoxal | 15 | 15 | 15 |
| Aluminum sulfate/ magnesium sulfate catalyst | 13 | 13 | 13 |
| Anionic wetting agent | 1 | 1 | 1 |
| Polydimethyl siloxane fluid emulsion | 5 | 5 | 5 |
| Sodium perborate | — | 0.1 | 0.5 |

The above treated fabrics were then evaluated for improvement in whiteness by measuring their reflectance on a Macbeth MC1010 Spectrocolormeter. The whiteness index was calculated from the C.I.E. Tristimulus Values by the formula W.I.=4Z−3Y, using standard illuminant C. A high whiteness index indicated a good white appearance.

The following whiteness indexes were achieved:

| Sample | Whiteness Index |
|---|---|
| 1 | 138.56 |
| 2 | 152.36 |
| 3 | 154.20 |

The following durable press and shrinkage values were obtained.

| | DP | | Shrinkage (W,F) | |
|---|---|---|---|---|
| Sample | 1W | 5W | 1W | 5W |
| 1 | 3.25 | 3.25 | .28,0 | .83,0 |
| 2 | 3.25 | 3.25 | .28,0 | .83,0 |
| 3 | 3.25 | 3.25 | .28,0 | .83,0 |

These results indicate that the inclusion of sodium perborate in finishing mixes 2 and 3 increased the whiteness significantly without diminishing the durable press or shrinkage properties.

Another study was conducted to evaluate the effect of changes in concentration of sodium perborate at higher glyoxal levels on the whiteness index, durable press, and shrinkage. The following mixes were prepared and evaluated on Springs 65/35 polyester/cotton Style 393. In each sample a wet pickup of approximately 60 percent was achieved after padding with the finish mix. The samples were then dried and cured as before at 250° F. for 30 seconds and 400° F. for 20 seconds respectively.

| Chemicals (Grams/Liter) | Mix 1 | Mix 2 | Mix 3 | Mix 4 |
|---|---|---|---|---|
| Glyoxal 40 | 50 | 50 | 50 | 50 |
| Polydimethyl siloxane fluid emulsion | 10 | 10 | 10 | 10 |
| Magnesium sulfate/ aluminum sulfate catalyst | 20 | 20 | 20 | 20 |
| Anionic wetting agent | 1 | 1 | 1 | 1 |
| Sodium perborate | — | 0.05 | 0.1 | 0.2 |

The following whiteness, durable press and shrinkage results were obtained.

| Sample | Whiteness Index | DP 1W | DP 5W | Shrinkage (W,F) 1W | Shrinkage (W,F) 5W |
|---|---|---|---|---|---|
| 1 | 127.6 | 4.0 | 3.5 | .28,0 | .83,0 |
| 2 | 128.6 | 3.5 | 3.25 | .56,0 | .94.0 |
| 3 | 144.6 | 3.5 | 3.5 | .56,0 | .83,.28 |
| 4 | 148.3 | 3.5 | 3.5 | .28,0 | .94.0 |

The data indicate that by including sodium perborate in the finish bath, one is able to improve the whiteness of the finished fabric. There is a slight decrease in durable press and shrinkage performance, indicating that an optimal level for each chemical in the formulation should be determined.

Another experiment was conducted to evaluate the use of alternative oxidizing agents in the finish bath. Obviously, the compounds evaluated are not inclusive and many other compounds, such as hydrogen peroxide and other peroxides, persulfates, percarbonates, potassium periodate, peroxyphosphates, perchlorates, organic per-acids, chlorites, hyporchlorites, etc. would be expected to improve the whiteness of the finished fabric.

The following finish mixes were evaluated under the same padding, drying and curing conditions using Springs 65/35 polyester/cotton Style 411.

| Chemicals (Grams/Liter) | Mix 1 | Mix 2 | Mix 3 | Mix 4 |
|---|---|---|---|---|
| Glyoxal 40 | 120 | 120 | 120 | 120 |
| Aluminum sulfate/ magnesium sulfate catalyst | 40 | 40 | 40 | 40 |
| Polydimethyl siloxane fluid emulsion | 15 | 15 | 15 | 15 |
| Sodium perborate | — | 0.4 | — | — |
| Sodium percarbonate | — | — | 0.4 | — |
| Peracetic acid* | — | — | — | 15 |
| Anionic wetting agent | 1 | 1 | 1 | 1 |

*Prepared by adding 2 parts of 50-percent hydrogen peroxide to 1 part acetic anhydride.

The fabric samples were evaluated as before for whiteness, durable press, and shrinkage properties.

| Sample | Whiteness Index | DP 1W | DP 5W | Shrinkage (W,F) 1W | Shrinkage (W,F) 5W |
|---|---|---|---|---|---|
| 1 | 108.4 | 4.0 | 4.0 | .56,.28 | .56,.28 |
| 2 | 117.3 | 3.5 | 3.5 | .28,.28 | .56,.28 |
| 3 | 120.1 | 4.0 | 3.5 | .56,.28 | .94,.28 |
| 4 | 119.7 | 4.0 | 3.5 | .56,.28 | .83.,28 |

The data demonstrate that these alternative oxidants will also improve the whiteness ratings of the treated fabrics with only minimal lowering of the durable press and shrinkage performance.

EXAMPLE VI

To determine the effect of afterwashing fabric treated with other glyoxal based resins which also impart fabric yellowing, the following trials were conducted on production equipment.

The processing parameters were as follows:
Range Speed: 125 yards/minute
Range Temperature: 385°-395°-395° F.

The fabric was preblued with the following formula based on 250-gallon mix:

| | |
|---|---|
| Violet 3B | 28 oz. |
| Red B | 3 oz. |
| BRW Brightener | 210 oz. |

The finish mixes were padded on in the conventional manner followed by passing the fabric over a vacuum slot having a vacuum of 12 in. Hg.

| Chemical | Percent OWB |
|---|---|
| FINISH MIX 1 | |
| BASF Resin NFU | 15.0% |
| Catalyst 135-B | 3.8% |
| Softener CD | 3.9% |
| Springswet 300 | 0.1% |
| FINISH MIX 2 | |
| Permafresh ZF-3 | 15% |
| Catalyst 135-B | 3.8% |
| Softener CD | 3.0% |
| Springset 300 | 0.1% |

The wet pickup achieved after vacuuming was approximately 27 percent.

The fabric then was oxidatively afterwashed by passing through four wash boxes at 160° F. containing the following formulation on the weight of the bath:

| | |
|---|---|
| Sodium perborate | 2% |
| Hydrogen peroxide (50%) | 1% |
| Soda ash | 0.5% |
| Springs Stabilizer 100 | 0.5% |

The fabric was then top softened followed by drying on cans. The top softening formulation consisted of the following formula based on the weight of the bath:

| | |
|---|---|
| Softener 1442 | 4.0% |
| Acetic acid (50%) | 0.2% |
| Springswet 300 | 0.05% |

Both of these finish formulations have been observed in the laboratory to exhibit yellowing.

The following values were achieved on the above production trials:

| Mix | Whiteness Index | Durable Press 1W | Durable Press 5W | Shrinkage (W,F) 1W | Shrinkage (W,F) 5W |
|---|---|---|---|---|---|
| 1 | 188 | 3.2 | 3.1 | 1.39,0 | 1.67,0 |
| 2 | 189 | 3.2 | 3.1 | 1.50,0 | 2.22,0 |

This study indicates that good whiteness may be achieved on fabrics treated with glyoxal-based resins followed by oxidative afterwashing.

EXAMPLE VII

To demonstrate the improvement in shade stability during storage achievable through oxidative afterwashing, the following glyoxal finish bath was prepared:

| Chemical | Grams/5 Gallons | Percent |
|---|---|---|
| Glyoxal 40 LF | 2760 | 12.0 |
| Polydimethyl siloxane fluid emulsion | 345 | 1.5 |
| Aluminum sulfate/ magnesium sulfate catalyst | 920 | 4.0 |
| Springswet 300 | 23 | 0.1 |

The mix was padded on preblued Springs 65/35 polyester/cotton Sytle 411 with a wet pickup of approximately 50 to 60 percent. The fabric was dried on the tenter frame at 250° F. for one minute, then cured in the tenter frame at 400° F. for 20 seconds.

Part of the fabric was then given an oxidative afterwash in the dye jig at 160°-180° F. using the following formula:

| Chemical | Grams/5 Gallons | Percent |
|---|---|---|
| Hydrogen peroxide (50 percent) | 6900 | 3.0 |
| Caustic (50 percent) | 2300 | 1.0 |
| Sodium silicate | 2300 | 1.0 |

The fabric was then rinsed, neutralized with acetic acid, following by a final rinse. The fabric was finally dried on the tenter frame at 250° F. for one minute.

An initial whiteness index was determined, and then the samples were stored in the dark in a laboratory desk drawer. The samples were remeasured after two years again for their whiteness indexes. The following results were obtained:

| Sample | Whiteness Index September 1982 | Whiteness Index September 1984 |
|---|---|---|
| Glyoxal finished | 146.7 | 104.8 |
| Glyoxal finished plus oxidative afterwash | 166.1 | 166.1 |

The above test indicates that the oxidative afterwash treatment of glyoxal finish fabric will stabilize the white shade and prevent yellowing during storage.

Part of the fabric was then oxidatively afterwashing at 160° F. in a solution consisting of the following for approximately 30 seconds, followed by souring in a dilute acetic acid solution and final water rinsing.

| Chemical | Grams per 2 Liters |
|---|---|
| Hydrogen peroxide (50%) | 60 |
| Caustic (50%) | 20 |
| Sodium Silicate | 20 |
| Springscour 155 | 2 |

Fabric samples from both the original and oxidatively afterwashed were then aged in a humid oven at 240° F. for 5.5 hours and were again evaluated for whiteness, durable press, and shrinkage.

The following results were obtained:

| Fabric Sample | Whiteness Index | Durable Press 1W | Durable Press 5W | Shrinkage (W,F) 1W | Shrinkage (W,F) 5W |
|---|---|---|---|---|---|
| Glyoxal Finished | 144.6 | 3.5 | 3.5 | .28,.28 | .83,.28 |
| Glyoxal Finished/ Afterwashed | 170.8 | 3.5 | 3.5 | 0,.28 | .56,0 |
| Aged Glyoxal Finished | 56.9 | 3.5 | 3.5 | .28,.28 | .56,0 |
| Aged Glyoxal Finished/ Afterwashed | 124.5 | 3.5 | 3.5 | 0,.28 | .28,0 |

These results indicate that upon accelerated aging, the oxidative afterwash will significantly reduce fabric yellowing of Glyoxal finished fabric.

While the invention herein is described in what is presently believed to be a practical preferred embodiment thereof, it will be apparent many modifications may be made within the scope of the invention, which scope is to be accorded the broadest interpretation of the appended claims so as to encompass all equivalent methods and fabrics.

What is claimed is:

1. In a method of obtaining a durable press textile fabric containing cellulosic fibers, wherein said textile fabric has been treated with a non-formaldehyde finishing agent taken from the group consisting essentially of glyoxal, non-formaldehyde polymers of glyoxal and aldehydes, the improvement characterized in that said textile fabric is subjected to an oxidative afterwash treatment following treatment with said non-formaldehyde finishing agent to prevent yellowing of said fabric upon storage, said afterwash treatment comprising the steps of:

washing said fabric a first time in an oxidative solution containing an oxidate, a stabilizer compound, a base, and a surfactant;

washing said fabric a second time in a neutralizing solution to thereby neutralize said oxidant;

rinsing said textile fabric in an aqueous solution; and drying said textile fabric.

2. A method according to claim 1, wherein said oxidant is taken from the group consisting essentially of sodium peroxide, sodium perborate, sodium percarbonate, hydrogen peroxide, sodium perchlorate potassium periodate, peroxyphosphates, peroxysulfates and organic peracids.

3. A method according to claim 1 wherein said stabilizer comprises one or more compounds taken from the group consisting essentially of sodium silicate, phosphate esters, magnesium salts, phenols, amines, amides, and phosphates.

4. A method according to claim 1, wherein said oxidative solution further comprises a chelating agent.

5. A method according to claim 1, wherein said neutralizing solution contains a dilute organic acid.

6. A method according to claim 1, wherein said textile fabric is exposed to said oxidative solution for a period of time between 5 seconds and 5 minutes and at a temperature between 40° and 200° F.

7. A method according to claim 1, wherein said textile fabric is exposed to said oxidative solution for a period of time between 5 and 90 seconds and at a temperature between 160° and 180° F.

8. A method according to claim 1, wherein said textile fabric is subjected to said oxidative afterwash treatment simultaneously with said non-formaldehyde finishing agent.

9. A method according to claim 1, wherein the concentration of said oxidant in said oxidative solution is maintained at a level equal to or less than 1% based on the total weight of said oxidative solution.

* * * * *

UNITED STATES PATENT AND TRADEMARK OFFICE

CERTIFICATE OF CORRECTION

PATENT NO. : 4,623,356

DATED : November 18, 1986

INVENTOR(S) : Hendrix, James E.

It is certified that error appears in the above-identified patent and that said Letters Patent is hereby corrected as shown below:

On the title page, "2 Drawing Figures" should read -- 4 Drawing Figures --.

Figure 4:
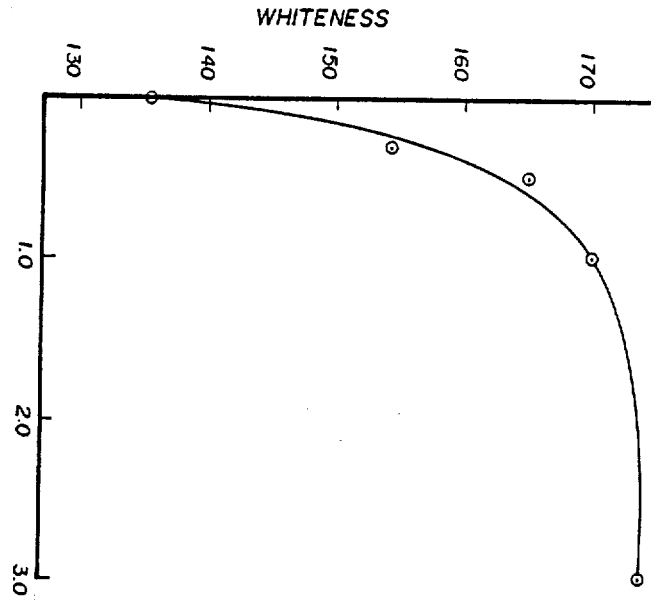
FIG. 4 graphically depicts the relationship between whiteness and peroxide concentration (% OWB) for oxidative afterwash treatments in accordance with the invention.

Figures 3 and 4 should appear as shown on the attached sheet.

Signed and Sealed this

Third Day of March, 1987

*Attest:*

DONALD J. QUIGG

*Attesting Officer*

*Commissioner of Patents and Trademarks*